US005346231A

United States Patent [19]

Ho

[11] Patent Number: 5,346,231

[45] Date of Patent: Sep. 13, 1994

[54] SKATE CONSTRUCTION WITH PRE-SET BUFFERING, SHOCK-ABSORBING AND THE TOPOGRAPHY COMPLIANCE FUNCTIONS

[76] Inventor: Diana Ho, No. 13, Tien Shui W. 6 Street, Taichung, Taiwan

[21] Appl. No.: 9,708

[22] Filed: Jan. 27, 1993

[51] Int. Cl.[5] ..... A63C 17/06

[52] U.S. Cl. ..... 280/11.2; 280/11.22

[58] Field of Search ..... 280/11.2, 11.22, 11.23, 280/842, 843, 11.27, 11.28

[56] References Cited

U.S. PATENT DOCUMENTS

| | | | |
|---|---|---|---|
| 64,301 | 4/1867 | Flint | 280/11.22 |
| 1,034,649 | 8/1912 | Rice | 280/11.27 |
| 1,116,840 | 11/1914 | Porter | 280/11.22 |
| 1,866,134 | 7/1932 | Smith | 280/11.23 |
| 1,975,661 | 10/1934 | Powell | 280/11.27 |
| 2,377,366 | 6/1945 | Paystrup | 280/11.23 X |
| 3,339,936 | 9/1967 | Hamlin | 280/11.23 X |
| 3,700,253 | 10/1972 | Heitfield | 280/11.2 |
| 4,034,995 | 7/1977 | Forward et al. | 280/11.23 X |
| 4,294,455 | 10/1981 | Krueger | 280/11.2 |
| 4,328,627 | 5/1982 | Sanders | 280/11.2 X |
| 4,394,028 | 7/1983 | Wheelwright | 280/11.2 X |
| 4,417,737 | 11/1983 | Suroff | 280/11.2 X |
| 4,453,726 | 6/1984 | Ziegler | 280/11.2 |
| 4,943,075 | 7/1990 | Gates | 280/11.2 X |
| 5,029,882 | 7/1991 | Marandel | 280/11.2 |
| 5,106,110 | 4/1992 | Williamson | 280/11.2 |
| 5,183,276 | 2/1993 | Pratt | 280/11.22 |

*Primary Examiner*—Brian L. Johnson
*Assistant Examiner*—Florian Zeender
*Attorney, Agent, or Firm*—Lowe, Price, LeBlanc & Becker

[57] ABSTRACT

A skate construction with pre-set buffering, shock-absorbing and the topogrphy compliance functions essentially composed of a footwear, a sole plate, a set of suspended support arms, a set of buffer wheels and a stop fixed block placed on the terminal portion of the sole plate, which is mainly characterized in that by employing a design of a low resistance rubber inflatable tire in combination with a single hub type support, a skate construction is given for keeping stable and smooth when the skate is used on lawns, concrete, unleveled or asphalt pavements.

3 Claims, 7 Drawing Sheets

SKATE CONSTRUCTION WITH PRE-SET BUFFERING, SHOCK-ABSORBING AND THE TOPOGRAPHY COMPLIANCE FUNCTIONS

BACKGROUND OF THE INVENTION

1. Field of the invention

The present invention relates to skates including a skate containing a single hub type support design in combination with a low resistance rubber inflatable tire to provide buffer, shock-absorbance and topography compliance functions thereby maintaining stability and equilibrium when used on lawns, concrete, unleveled or asphalt pavements.

2. Description of the prior art

As shown in FIG. 1, a conventional PU wheel type wheel skate is one that on the sole 10, there is screw provided with a double-face riveted jointed rigid support plate 11, and between the rigid plates 11 there is screw jointed with a low resistence PU wheel 13 by a screw 12, respectively. Because the PU wheel 13 is made of hard rubber, the utility of conventional wheel skates is limited to specialized playgrounds. During movement, if the PU wheel 13 encounters granules such as small stones or sand, the sportman will lean, slide and fall down, possibly resulting in serious injury. Moreover, because the rigid support plate 11 and the PU wheel 13 hard rubber lack of shock-absorbant properties, the feet of the sportman will suffer the reverse force frequently during the sport, thereby risking a serious injury to the head.

Another conventional PU wheel type wheel skate which also often is at risk due to unleveled terrain or sand and small stones is as depicted in FIG. 2 in which doubleline, low resistant PU wheels 21 are pivotally equipped at both ends of the triangle support 22 below the sole. Though triangle support 22 is joined to the sole plate 23 by two fulcrums 221, 222, when this type of a wheel skate in touches uneven pavement, owing to the improper design of PU wheels 21 with rigidity and low resistance and to the rigid structure of the triangle support 22, the skate is not able to make an efficient buffer and maintain equilibrium. This type of wheel type skate often endangers the user.

In view of the potential dangers stemming from the design of conventional PU wheel type wheel skates, the present inventor engaged in research and development and after an extensive experimentation and testing, the present invention was achieved.

SUMMARY OF THE INVENTION

Accordingly, a main object of the present invention is to provide a skate construction having buffer, shock-absorbance and topography compliance functions due to the use of inflatable rubber tires thereby providing safety and protection while exercising on various terrains and surfaces.

Another object of the invention is to provide a skate having buffer, shock-absorbance and topography compliance functions by means of a design comprising a single hub type support in combination with low resistance rubber inflatable tires Another object of the invention is to provide a skate having buffer, shock-absorbance and topography compliance functions which enables the skate to be used on lawns, concrete, unleveled or asphalt pavements. A further object of the invention is to provide a skate having buffer, shock-absorbance and topography compliance functions so that a double-rank wheel skate is in compliance with various terrains and surfaces and exhibits pre-set functions.

Other objects, features and characteristics of the present invention as well as the detailed structures, application principles and action/effect will become more apparent upon consideration of the following detailed description with reference to the accompanying drawings.

DETAILED DESCRIPTION OF THE PREFERRED EMBODIMENTS

Figure 1:
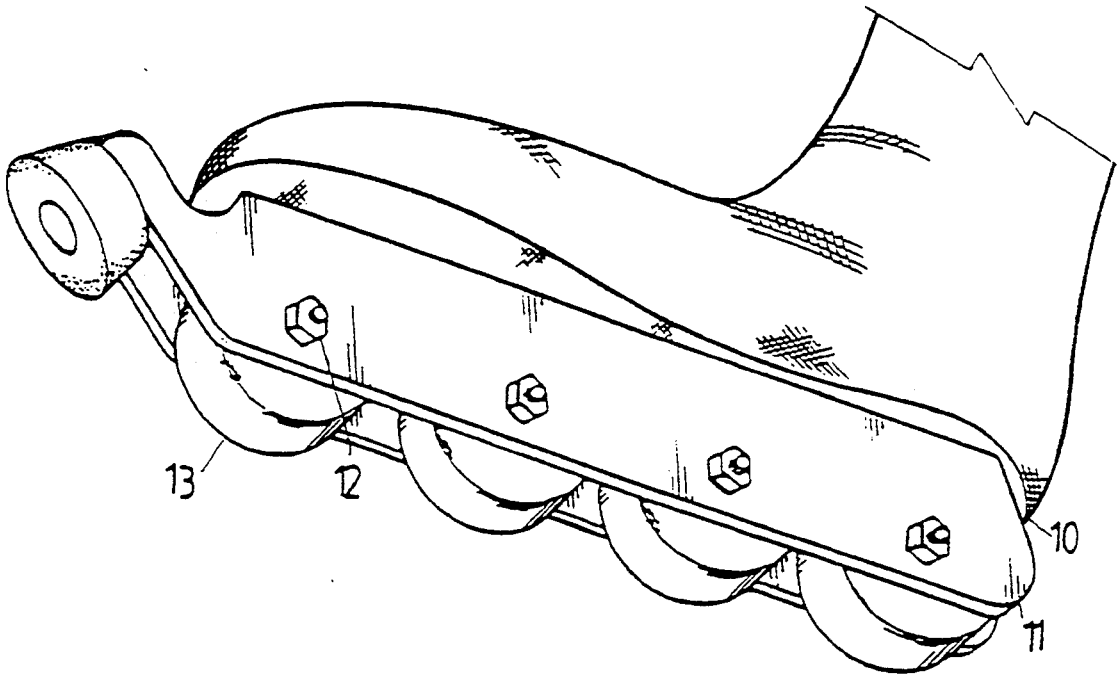
FIG. 1 (PRIOR ART)
FIG. 1 is a schematic view showing the appearance of a conventional straight line type skate.
Figure 2:
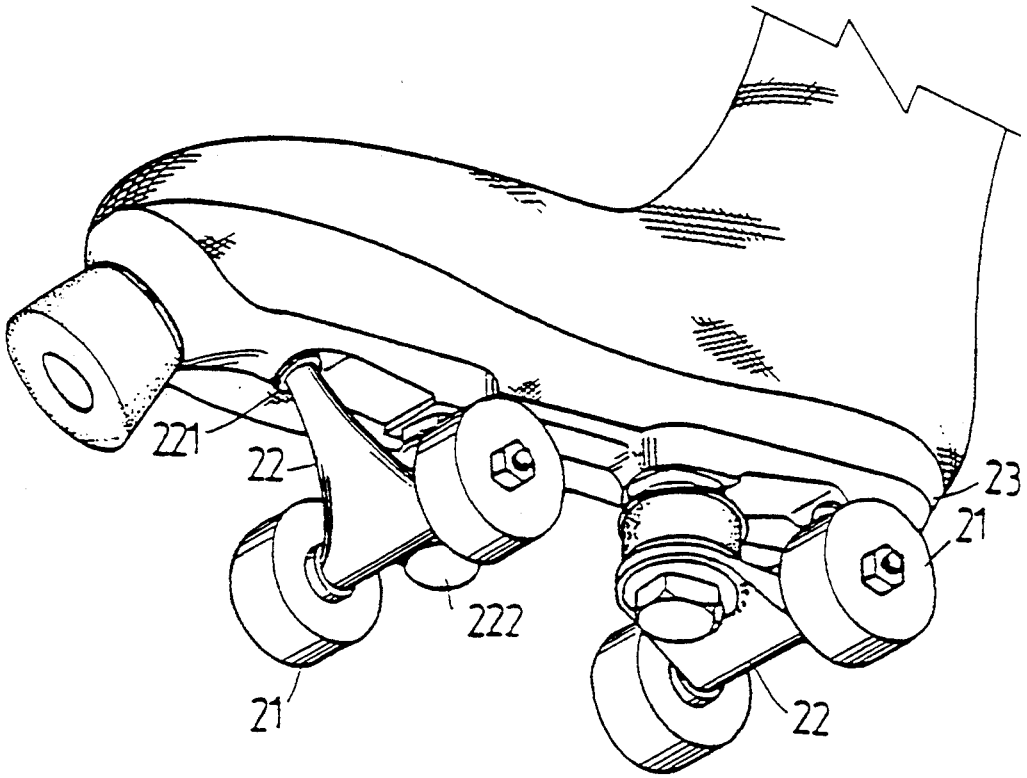
FIG. 2 (PRIOR ART)
FIG. 2 is a schematic view showing the appearance of a conventional four wheel type skate.

The construction and drawbacks of the conventional wheel type skates as shown in FIGS. 1 and 2 are described as the disclosure hereinbefore and will not be repeated here.

Figure 3:
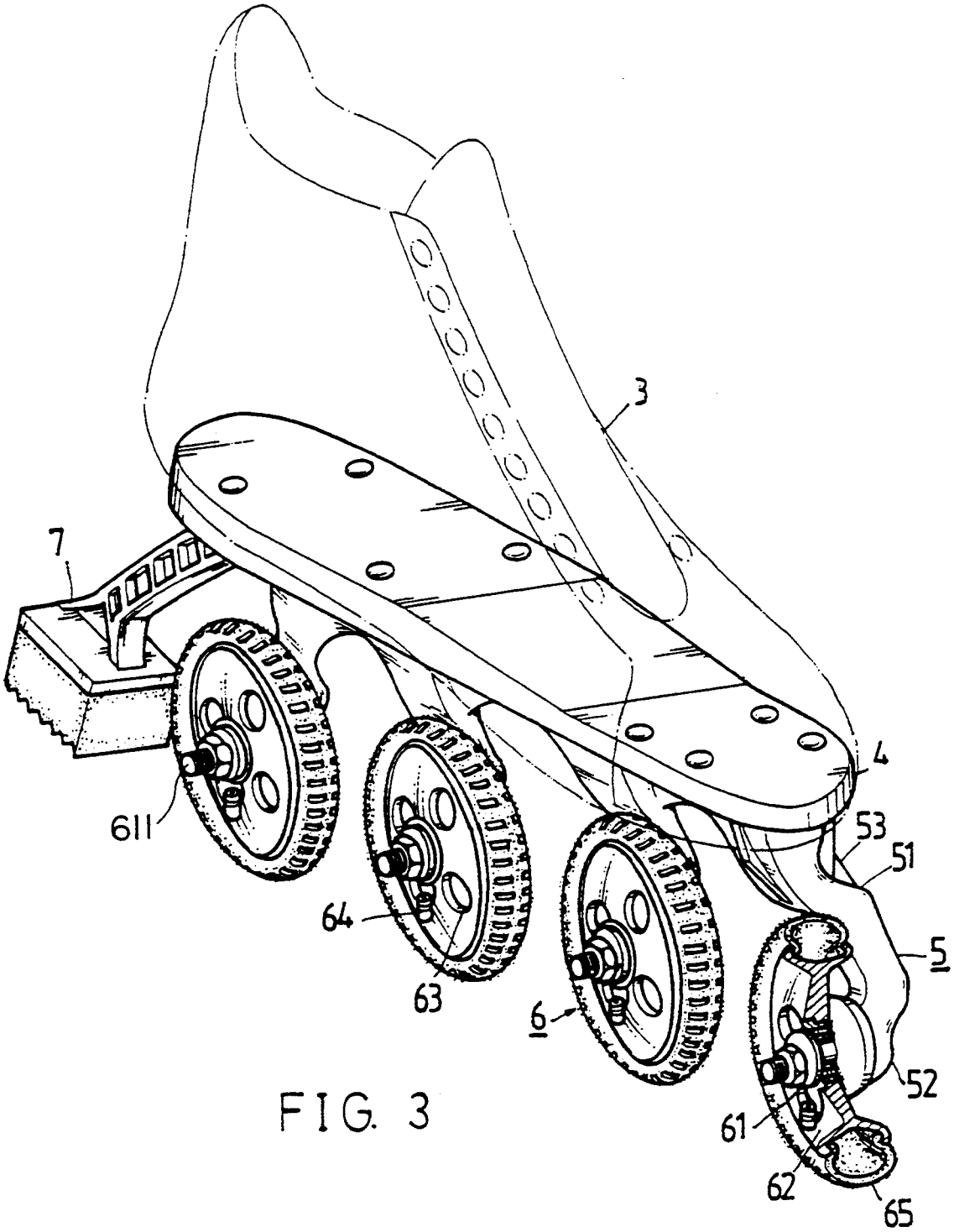
FIG. 3 is a perspective partly sectional view of the skate of the present invention.
Figure 4:
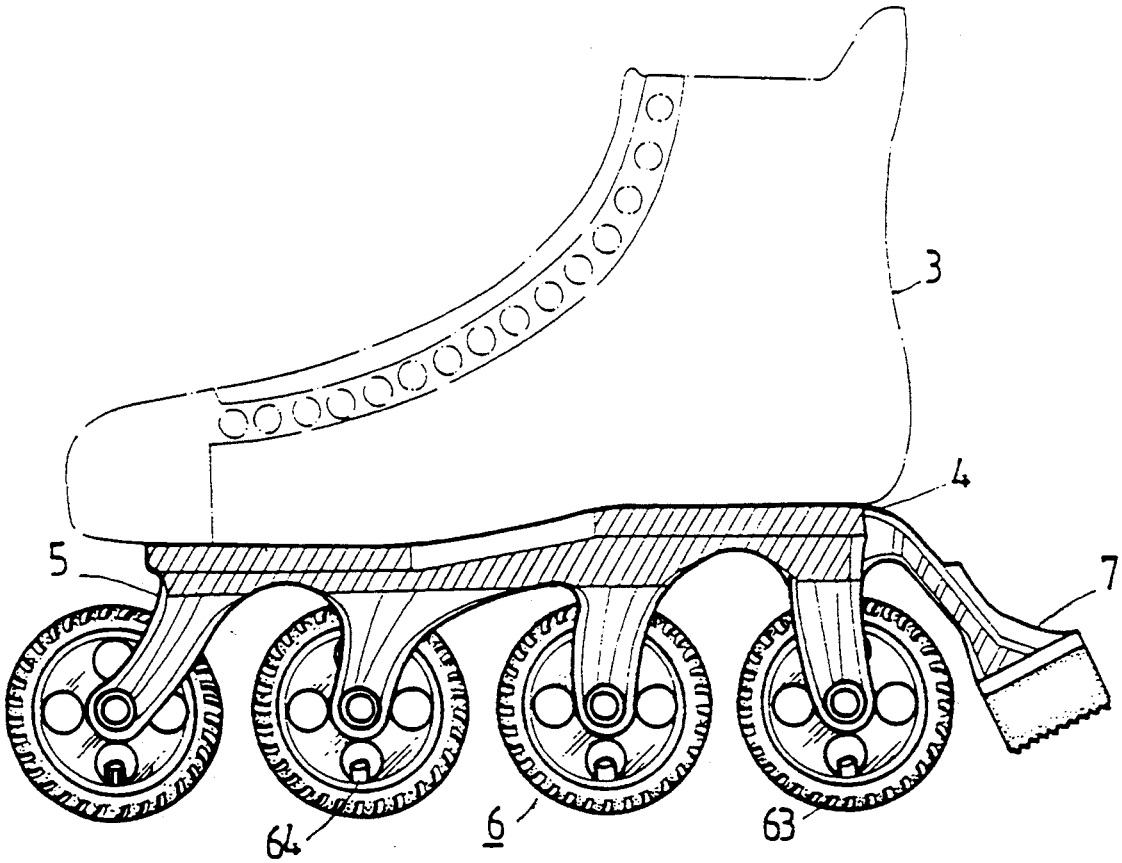
FIG. 4 is a right elevational view of the skate of the invention.

Referring to FIGS. 3 and 4, it can be clearly seen that the skate according to the present invention comprises a footwear 3, a sole plate 4, several suspended support arms 5, several buffer wheels 6 and a stop fixed block 7 wherein, the sole plate 4 has a footwear 3 firmly provided on the top side thereof and, four suspended support arms 5 integrally downwardly formed on the bottom side thereof; the suspended support arms 5 made of rigid material has a bow form bending to one side and forms an up and a down bend 51, 52; between the up bend 51 thereof and the sole plate 4 there are fixedly installed with several reinforcing ribs 53 to reinforce the upward bending resistance of the suspended support arms 5; and at the lower end of the suspended support arm 5 there is borderly provided with a horizontal axle hole 161 (FIG. 5) to pivot joint the buffer wheel 6.

The buffer wheel 6 is essentially a design of single hub, pneumatic wheel which has a wheel hub 61 integrally formed with a wheel ring 62 and pivot jointed with the axle hole 161 of the suspended support arm 5 by a bolt 611. There are formed several conduit hole 68 on the side portion of the wheel ring 62 to improve the stability of the ring in motion. At the edge of one of these conduit hole 68 near the outer border of the wheel ring 62, an air valve 64 is provided to supply the pneumatic tire 65 provided on the outer periphery of the ring 62 with air. Owing to the ring hook 621 (FIG. 5) appropriately installed on the outer periphery of the wheel ring 62, the joining between the pneumatic tire 65 and the ring 62 is improved.

Figure 5:
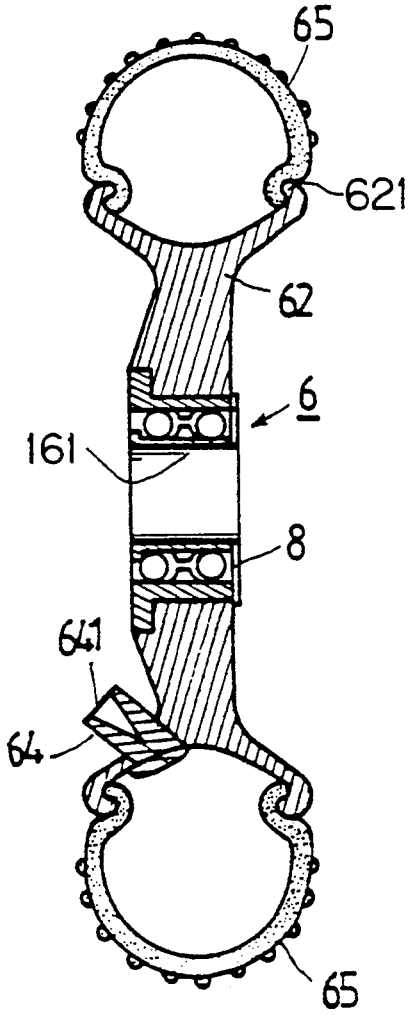
FIG. 5 is a sectional view showing the skate-wheel of the invention.
Figure 6A:
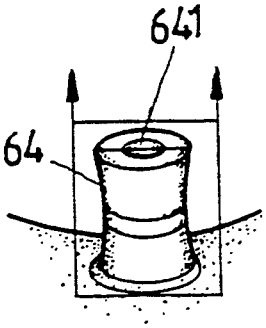
FIGS. 6*a* and 6*b* show a perspective and a sectional view respectively of the air valve of the invention.
Figure 6B:
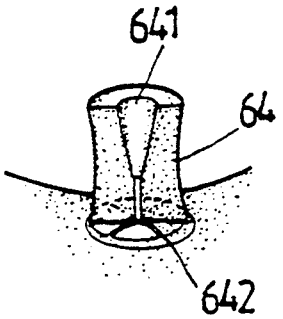

As to the detailed construction of the buffer wheel 6, we can see from FIGS. 5 and 6 that where the hub 61 pivot joining with the axle hole 84 of the suspended support arm a ball bearing 8 is installed to facilitate its operation. The air valve 64 installed on the outer border of the ring is formed of soft rubber and its inside has an air path 641 and crossed tight seams 642. By means of the plasticability of the soft rubber, while in the absence of a strong air injection the air valve 64 is closed. When the air pressure introduced reaches a certain level, the air path 641 and crossed tight seams 642 are forced to produce an air pathway whereby the pneumatic tire 65 may commodate different athletic fields and maintain a suitable rigidity. Moreover, by the aid of the tire pattern on the outer rim of the tire the buffer wheel 6 is more ground grabbing and more stable.

A skate of the abovesaid construction, due to the buffer and shock absorbing characteristics possessed by the suspended support arm 5 and the buffer wheel 6, prevents the athlete from the response force from the ground during the exercise and assures the athlete of cerebral safety and also avoids other exercise harms. Additionally, since to the buffer wheel 6 is provided with a pneumatic tire better stability is obtained with respect to different pavements.

Figure 7:
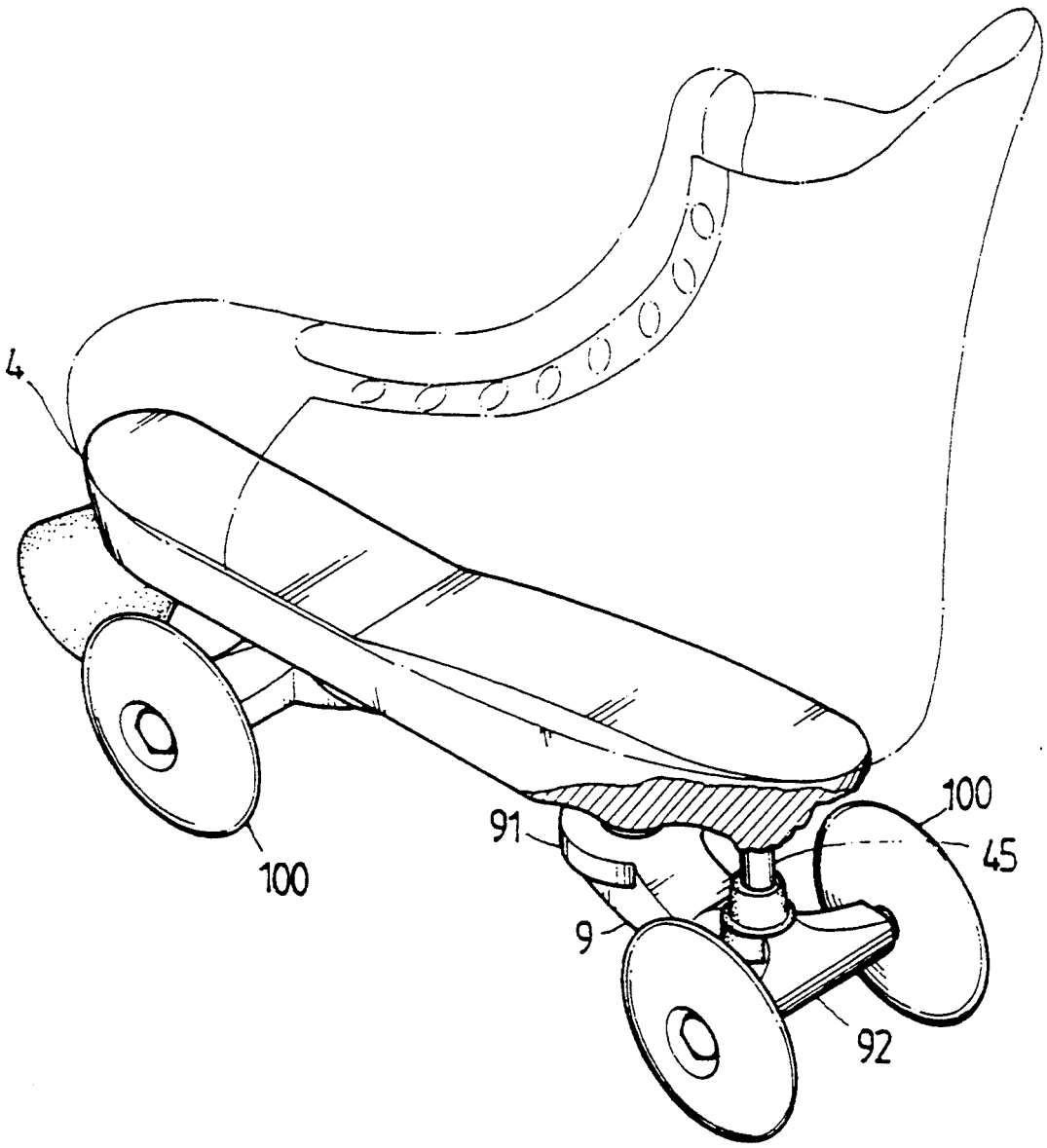
FIG. 7 shows another embodiment of the skate of the invention.
Figure 8:
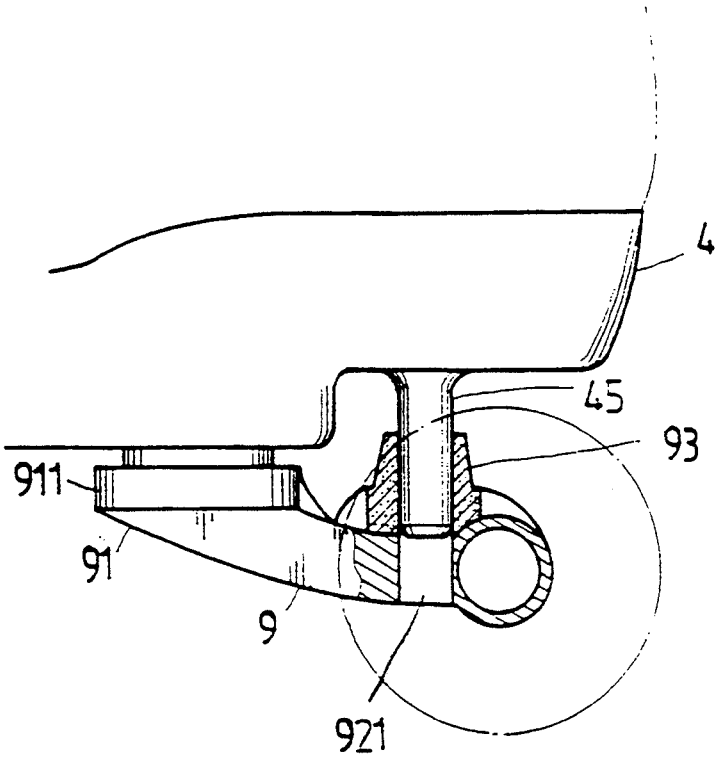
FIG. 8 is a sectional view showing the support construction of an embodiment of the invention.

On the basis of a pre-setting buffering and shock-absorbing principle, another embodiment of the present invention is as shown in FIGS. 7 and 8 in which at the lower front and back end of the sole plate 4, there is opposedly, fixedly provided with a triangular support which is arranged oblique and formed of a rigid material. Between the head 91 thereof, a rubber ring 911 rigidly bound with the sole plate 4 and at the two sides of the back support 92, a PU wheel 100 pivot jointed thereto, respectively. At the center of the back support 92, a suitable through hole 921 is provided for penetrating the locating shaft lever 45 provided at a proper position outward of the front fixedly provision end of the sole plate 4 and the triangular support 9; and on the outer ring of the locating shaft lever 45 between the triangular support 9 and the sole plate 4, annularly provided with a cushion washer 93 for the vertical and horizontal direction synchronized cushioning, shock-absorbing and equilibrium actions of the back support 92 of the triangular support 9.

By means of the buffering characteristics thereof between the triangular support 9 and the sole plate 4, when the PU wheel 100 of said wheel-type skate is in touch with pavement having small sand granules or a certain oblique plane, the locating shaft lever 45 and the back support of the triangular support 9 have adjustability, whereby the sport safety of an athlete is assured.

Although the present invention has been fully described by way of example, it is to be noted here that various changes and modifications will be apparent to those skilled in the art. Therefore, unless otherwise such changes and modifications depart from the scope of the invention as defined by the appended claims, they should be included therein.

I claim:

1. A skate having buffering, shock-absorbing and topographical complying functions comprising: a footwear, a sole plate having atop side and a bottom side, wherein the footwear is firmly affixed to the top side of the sole plate, a stop block affixed to the heel portion of the sole plate, which stop block is capable of reaching the ground during use, a single hub suspended from the bottom side of the sole plate comprising a plurality of spaced suspended support arms, wherein each suspended support arm is made of a tough material having bending resilience and is in the form of a bow bending to one side of said skate forming an upper bend and a lower bend, a reinforcing rib connecting the upper bend of each support arm to the sole plate to reinforce the upward bending resistance of each support arm, a horizontal axle hole at the lower bend of each support arm, a plurality of buffer wheels, wherein each buffer wheel is connected to the sole plate solely by a single support arm pivotally coupled to only one side of each wheel at the axle hole via a ball bearing, each buffer wheel comprising a hub of rigid material and a ring provided with an air valve of soft material at a proper position to provide an air pathway for an inflatable tire positioned on the wheel ring; whereby the skate may be used on various terrains, including lawns, concrete pavements and unlevelled ground, and still exhibit buffering and shock-absorbing properties.

2. A skate according to claim 1, wherein the suspended support arms are screwed to the bottom side of the sole plate.

3. A skate according to claim 1, wherein each wheel ring is penetrated with several conduit holes on a lateral surface to improve stability in motion.

* * * * *